US005299865A

United States Patent [19]

Presnell

[11] Patent Number: 5,299,865

[45] Date of Patent: Apr. 5, 1994

[54] COUNTERPOISE HELICAL RIBBON MIXER

[75] Inventor: Dale Presnell, Fort Worth, Tex.

[73] Assignee: Hayes & Stolz Industrial Manufacturing Company Inc., Fort Worth, Tex.

[21] Appl. No.: 56,481

[22] Filed: May 3, 1993

[51] Int. Cl.[5] ..... B01F 7/08

[52] U.S. Cl. ..... 366/300; 366/319; 366/320

[58] Field of Search ..... 366/14, 15, 50, 64, 366/66, 83, 84, 168, 186, 194–196, 291, 297–301, 318–322, 603; 198/662, 670, 671, 675–677; 425/208, 209

[56] References Cited

U.S. PATENT DOCUMENTS

| | | | |
|---|---|---|---|
| 934,603 | 9/1909 | Gedge | 366/319 X |
| 2,498,237 | 2/1950 | Baymond . | |
| 2,761,657 | 9/1956 | Rietz | 366/291 X |
| 3,941,357 | 3/1976 | Wurtz . | |
| 4,036,477 | 7/1977 | Sieradzki et al. . | |
| 4,278,355 | 7/1981 | Forberg | 366/300 |
| 4,733,607 | 3/1988 | Star et al. | 366/320 X |
| 4,941,132 | 7/1990 | Horn et al. | 366/300 X |
| 5,083,506 | 1/1992 | Horn et al. | 366/297 X |

FOREIGN PATENT DOCUMENTS

| | | | |
|---|---|---|---|
| 1045372 | 12/1958 | Fed. Rep. of Germany . | |
| 1097411 | 1/1961 | Fed. Rep. of Germany . | |
| 1112968 | 8/1961 | Fed. Rep. of Germany . | |
| 1116196 | 11/1961 | Fed. Rep. of Germany . | |
| 1816674 | 8/1969 | Fed. Rep. of Germany . | |
| 1432024 | 10/1971 | Fed. Rep. of Germany | 366/297 |
| 375777 | 7/1907 | France | 366/320 |
| 7710404 | 3/1979 | Netherlands | 198/622 |
| 2039764 | 8/1980 | United Kingdom . | |

*Primary Examiner*—Philip R. Coe
*Assistant Examiner*—Charles Cooley
*Attorney, Agent, or Firm*—Arthur F. Zobal

[57] ABSTRACT

The mixer includes a chamber having first and second, side-by-side tub like cavities with first and second rotatable shafts located in the first and second cavities respectively. Each shaft has two ribbon members coupled to the shaft and which extend helically around the shaft along a substantial length of the shaft with the two ribbon members located about 180 degrees apart. The ribbon members of the two shafts do not intermesh but are located close to each other. A drive mechanism is provided for rotating the two shafts in opposite directions to cause the ribbon members of the two shafts to move toward each other below the plane of the two shafts, upward, and away from each other above the plane of the two shafts for mixing the particulate material. The ribbon members of the two shafts cause the particulate material in the two cavities to move in opposite directions along their lengths. Pitched paddles coupled to one end of one shaft and to one end of the other shaft at opposite ends of the chamber, cause pressure equalization and the particulate material at one end of the chamber to move from the first cavity to the second cavity and at the other end of the chamber to move from the second cavity to the first cavity to provide lateral circulation of the particulate material in the mixer chamber.

23 Claims, 6 Drawing Sheets

COUNTERPOISE HELICAL RIBBON MIXER

BACKGROUND OF THE INVENTION

1. Field of the Invention

The invention relates to a mixer for mixing or blending particulate solids in the dry state or with liquid addition.

2. Description of the Prior Art

Conventional mixing machines for mixing or blending particulate solids have taken various forms and have utilized various mechanical apparatuses to affect comingling of ingredients placed therein. The term mixing, however, has recently come to infer that a certain relationship by volume of each of the ingredients of the total mixer charge also exists in random samples taken from the mixed product batch. Since none of the prior art of mixers have been able to provide absolute perfection, most users of such equipment have adopted standards to express the accuracy of their specific mixing machines. Such standards usually utilize statistical formulae. In a similar manner, the requirements of todays mixing machines have been dictated with respect to the power consumed by the mixing operation.

Thus, the problem areas of the prior art mixers are the speed and accuracy of mixing and the power requirements.

Some of the known mixers use to rotatable shafts with paddles or helical ribbons, as disclosed by U.S. Pat. Nos. 4,036,477; 4,278,355; 5,083,506; 4,941,132; and U.K. Patent No. 2,039,764A which are discussed subsequently. Reference also is made to German Patent Nos. 1,116,196; 1,097,411; 1,112,968; 1,045,372; 1,816,674; U.S. Patent Nos. 3,941,357 and 2,498,237.

U.S. Pat. No. 4,036,477. This machine utilizes both paddles and ribbons, however, ribbon 42 is utilized to induce discharge of material from the mixing machine. It also transfers product from one mixing tub to the other, as do paddles 36, 39 & 41. Mixing in the apparatus is accomplished by the use of paddles pitched to provide induced flow of the material from one tub to the other.

U.S. Pat. No. 4,278,355. This machine uses no ribbons, only paddles for mixing purposes. It also utilizes paddles to transfer product from one tub to the other, although the mixing technique is different from that of the machine of the '477 patent. The machine of the '355 patent creates a "fluidized" area in which the, the claim is made, rapid and gentle mixing takes place when the shaft rotation is controlled within certain specific ranges of revolutions unit time (expressed as peripheral speed). The paddles 13 of this patent are not pitched but are flat in that they are parallel with the axis of the shaft so that maximum transport of product can be achieved. Thus increases the power required for mixing.

U.S. Pat. No. 5,083,506. The device of this patent utilizes a single course of helical ribbons for each of the two shafts. It relies on timely reversing of rotational direction to obtain retention in the machine so that adequate mixing can occur. In addition, the machine has jackets on the tub(s) through which steam or other heat inducing media is pumped. Further the machine is compartmented so as to allow for variance of temperature requirements in each compartment.

U.S. Pat. No. 4,941,132. The machine of this patent uses a single helical ribbon mounted on each of two opposing shafts so arranged that product being mixed moves in opposite direction within the tub housing. The directions of rotation of the shafts are periodically reversed.

U.K. Patent No. 2,039,764. The machine of this patent has helical ribbons which vary in width or pitch. It uses flat paddles to transfer product from one mixing area to another, along with a form of a helical ribbon placed downstream from the paddle itself clearly intended as its only purpose to move product from one mixing area to the other.

SUMMARY OF THE INVENTION

It is an object of the invention to provide a mixer for mixing solid particulates in the dry form or with liquid addition accurately at a short mix time and with minimal power requirements.

The mixer of the invention comprises a chamber having first and second, side-by-side tub like cavities with first and second rotatable shafts located in the first and second cavities respectively. Each shaft has two ribbon members coupled to the shaft and which extends helically around the shaft along a substantial length of the shaft with the two ribbon members located about 180 degrees apart. The ribbon members of the two shafts do not intermesh but are located close to each other. Means is provided for rotating the two shafts in opposite directions to cause the ribbon members of the two shafts to move toward each other below the plane of the two shafts, upward, and away from each other above the plane of the two shafts for mixing the particulate material.

In a further aspect, the ribbon members of the first shaft are coupled thereto in a manner to cause the particulate material in the first cavity to move from a first end wall toward a second end wall upon rotation of the first shaft. The ribbon members of the second shaft are coupled thereto in a manner to cause the particulate material in the second cavity to move from the second end wall toward the first end wall upon rotation of the second shaft. A first pitched paddle means is coupled to the first shaft near the second end wall in a manner to cause the particulate material, having congregated at the second end wall due to the ribbon members of first shaft having caused material movement in that direction, to be disposed away from the second end plate and therefore relieve the pressures caused by such movement against the second end wall. Such disposition having resulted from equalization of forces created by the material moving against the static end wall without relief, except for that created by the first pitched paddle. A second pitched paddle means is similarly coupled to the second shaft with similar results at that location. The paddles are pitched so that they can act to "knife" into the product and break up the pressure accumulation. Some of the product will be diverted to the adjacent tub.

DESCRIPTION OF THE PREFERRED EMBODIMENTS

Figure 1:
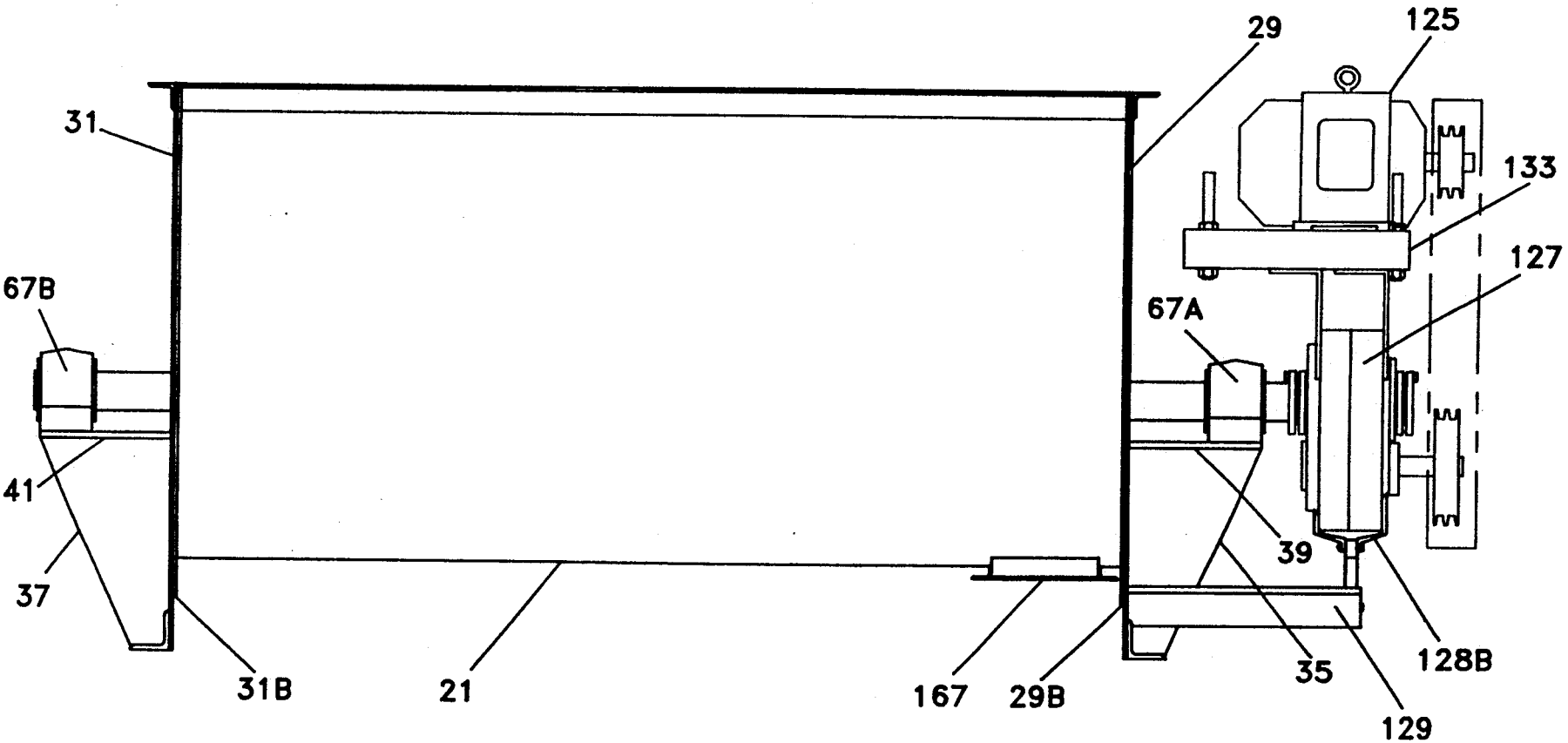
FIG. 1 is a side view of the mixer of the invention.

Referring now to the drawings, the mixer of the invention is identified by reference number 21. It is formed by two side walls 23 and 25, a bottom wall 27 comprising two bottom wall portions 27A and 27B, and two end walls 29 and 31 forming a chamber 33 for receiving particulate material to be mixed. The end walls 29 and 31 extend outward beyond the side walls 23 and 25 and have bottom portions 29B and 31B with lower straight edges for supporting the mixer 21 and its chamber 33 above the level of the floor. The walls of the mixer are made of suitable metal such as steel. The end walls 29 and 31 have metal brackets 35 and 37 attached thereto for supporting elevated metal platforms 39 and 41 respectively.

The inside distance between the end walls 29 and 31 is defined as the length of the chamber 33; the lowest points of the bottom wall portions 27A and 27B to the highest levels of the side walls 23 and 25 and end walls 29 and 31 is defined as the maximum height of the chamber and the maximum distance between the side walls 23 and 25 (along plane 57) is defined as the maximum width of the chamber 33.

The bottom wall portions 27A and 27B form circular arcs of the same radii about two axes 51 and 53 respectively. The inner edges 27AI and 27BI of the bottom wall portions 27A and 27B are joined together by welding at a midpoint 55 along the length of the chamber and their outer edges 27AO and 27BO join and extend to the lower portions of the side walls 23 and 25 forming two U-shaped tub-like cavities 33A and 33B for receiving the particulate material to be mixed. The midpoint 55 is located below the plane 57 of the axes 51 and 53 and above the lower level of the bottom wall portions 27A and 27B. The cavities 33A and 33B have the same dimensions.

Rotatably supported to extend along the axes 51 and 53 are two metal shafts 61 and 63. Holes are formed through the end walls 29 and 31 through which the outer ends 61A and 61B and 63A and 63B of the shafts 61 and 63 extend. Means (not shown) is provided for forming seals between the shafts 61 and 63 and the end walls 29 and 31 which allow the shafts to rotate.

The outer ends 61A and 61B and 63A and 63B of the shafts are supported for rotation by bearings 65A and 65B and 67A and 67B respectively. Bearings 65A and 67A are supported by platform 39 and bearings 65B and 67B are supported by platform 41.

Connected to shaft 61 for rotation therewith are two metal helical ribbon members 81 and 83. Metal rods or spokes 101A and 101B of the same length are attached to the shaft 61 to extend radially outward from opposite sides thereof at equally spaced intervals along the shaft with adjacent pairs of rods 101A and 101B extending 90 degrees relative to each other. See FIG. 6. Rods 101A are located to form a first helix around the shaft 61. Similarly, rods 101B are located to form a second helix around the shaft 61 but located 180 degrees relative to the first helix.

Figure 2:
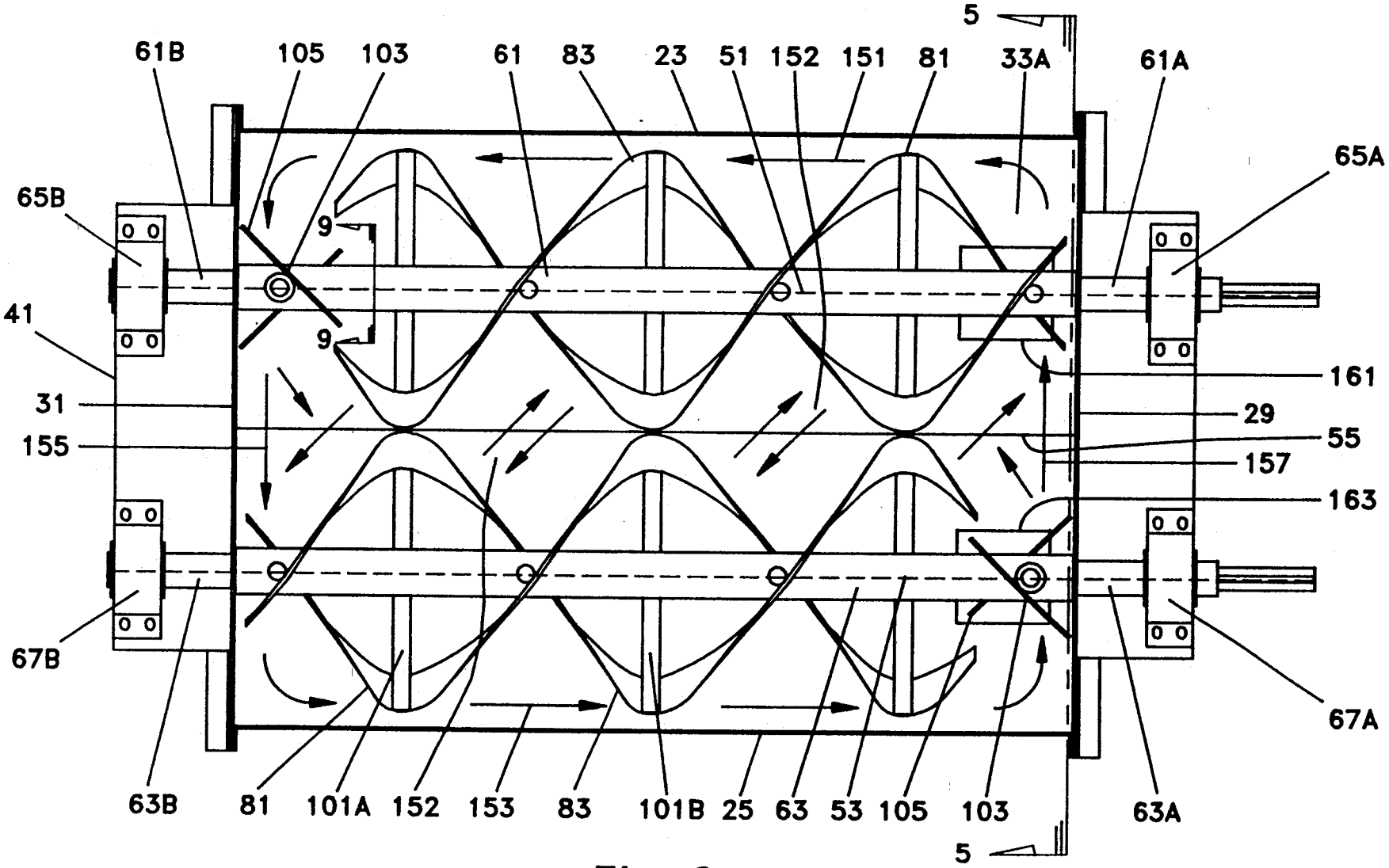
FIG. 2 is a top view of the mixer of FIG. 1.
Figure 3:
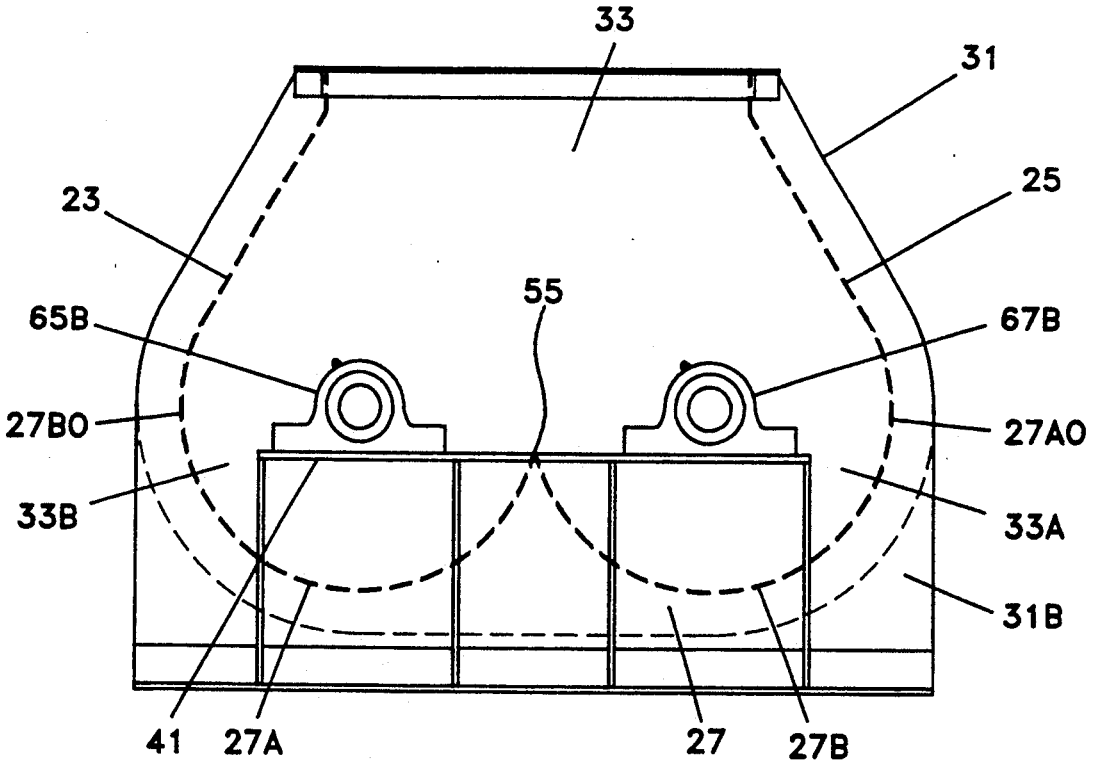
FIG. 3 is an end view of the mixer of FIG. 1 as seen from the left end in FIG. 1.
Figure 4:
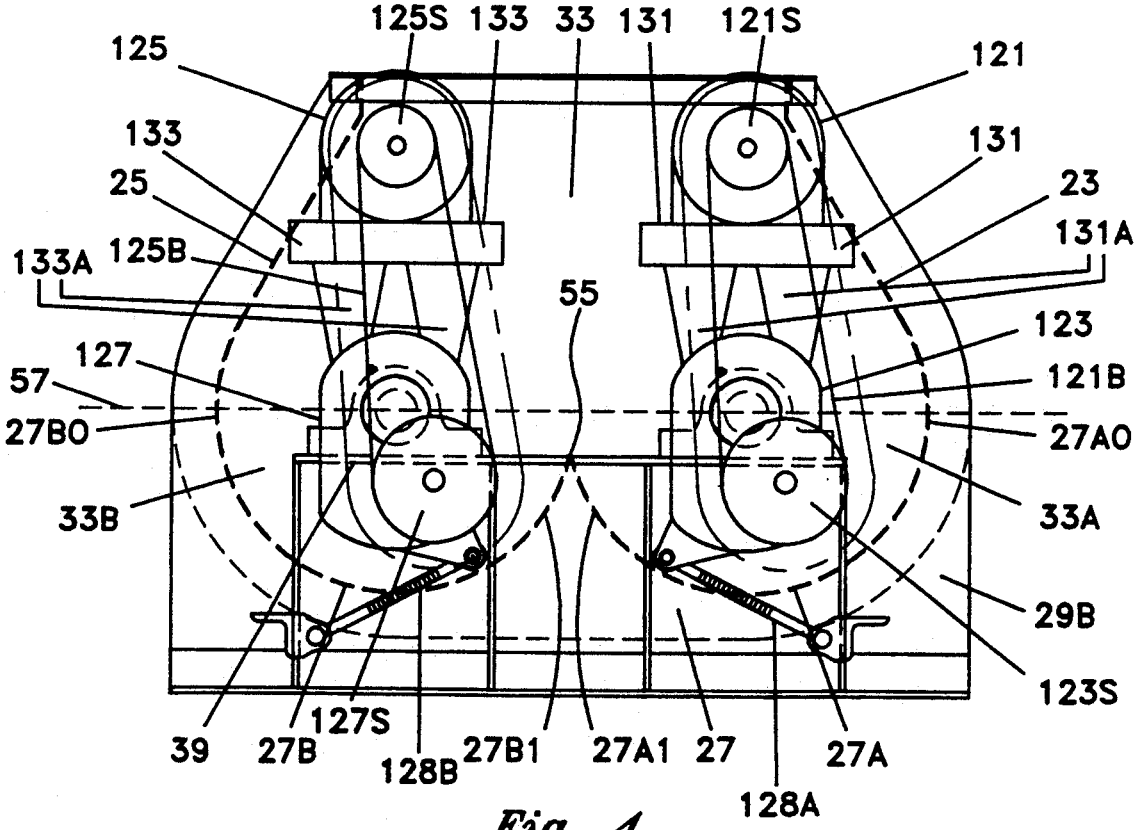
FIG. 4 is an end view of the mixer of FIG. 1 as seen from the right end of FIG. 1 and with the drive motors and gear reducers illustrated.
Figure 9:
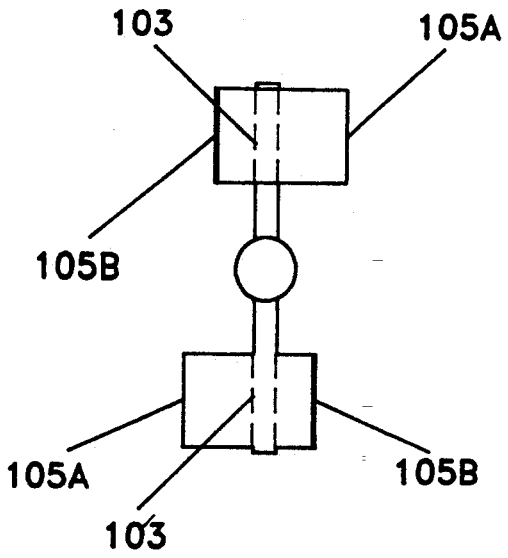
FIG. 9 is an enlarged view of one pair of pitched paddles as seen from lines 9—9 of FIG. 2.
Figure 6:
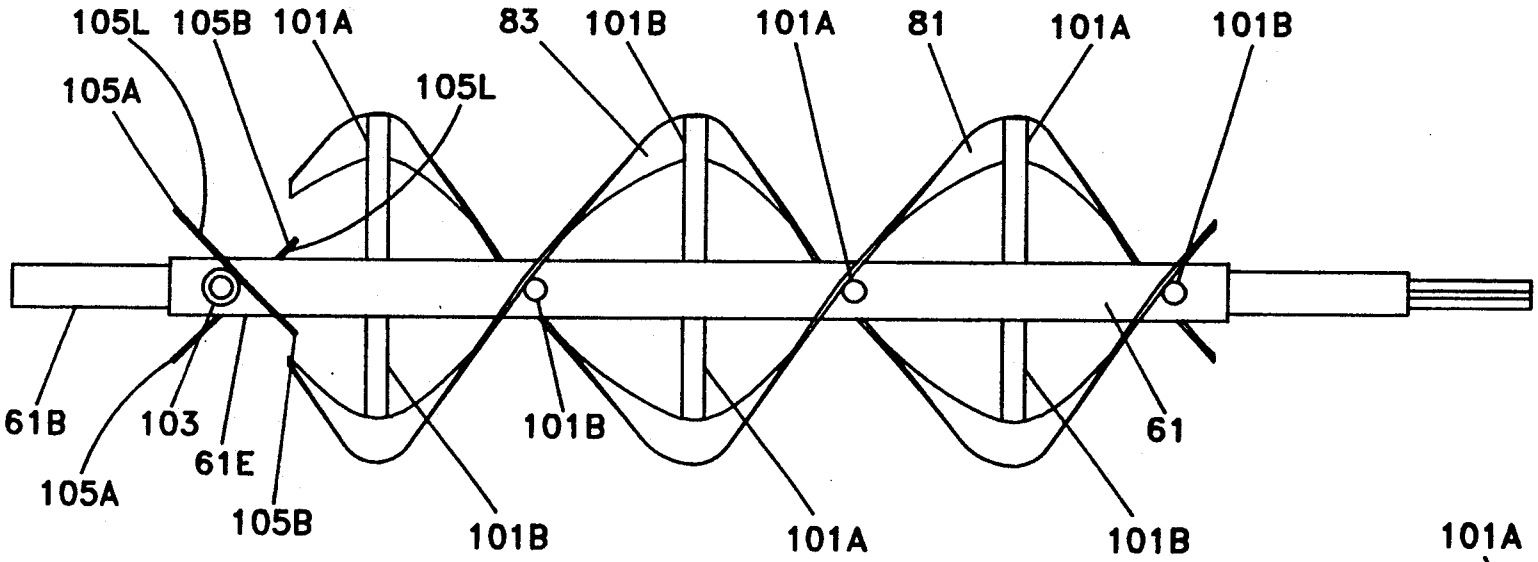
FIG. 6 is a side view of one of the mixing shafts with its ribbon blades.
Figure 7:
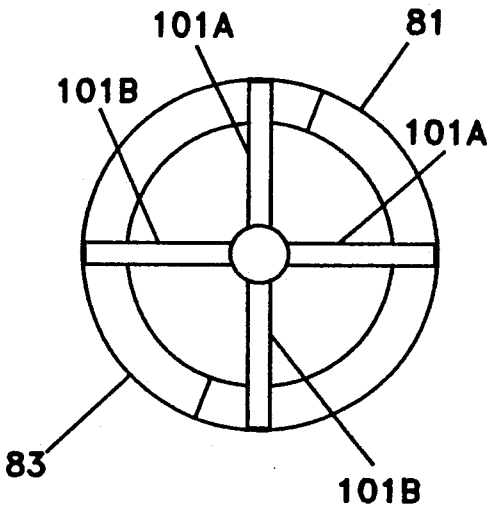
FIG. 7 is an end view of FIG. 6 as seen from the right end of FIG. 6.

Ribbon members 81 and 83 are elongated, thin, flat, metal members. Member 81 is wound around the shaft 61 and welded to the ends of spokes 101A to form a helix around the shaft as shown in FIGS. 2 and 6. At the connection of the ribbon 81 to the spokes 101A, the thin, flat, plane of the ribbon 81 is located along a radial line from the shaft 61. Similarly, member 83 is wound around the shaft and welded to the ends of the spokes 101B to form a helix around the shaft 61 as shown in FIGS. 2 and 6 which is located 180 degrees relative to the helix of ribbon 81. The outer diameters of helix members 81 and 83 are equal and constant throughout their lengths. The pitch angles of members 81 and 83 are equal and constant throughout their lengths. Both of the ribbons 81 and 83 have a right hand pitch.

Two spokes 103 are connected to the end 61E of shaft 61 on opposite side of the shaft to which pitched paddles or devices 105 are connected such that the paddles are transverse to each other.

Connected to shaft 63 for rotation therewith are two metal helical ribbon members 81 and 83 and two pitched paddles 105 the latter of which are transverse to each other. Shaft 63 with its ribbon members 81 and 83 and pitched paddles 105 are exactly the same and have the same dimensions as shaft 61 and its ribbon members 83 and 83 and paddles 105 such that the ribbon members 81 and 81 extend helically around the shaft 63 connected to the ends of the rods 101A and 101B respectively with the ribbon member 81 being located 180 degrees relative to ribbon member 83. Both of the ribbons 81 and 83 of shaft 63 have a right hand pitch. Shaft 63 with its ribbon members 81 and 83 and pitched paddles 105, however, is mounted within the chamber 33 of the mixer in an opposite position relative to shaft 61 and its ribbon members 81 and 83 and pitched paddles or devices 105.

Figure 5:
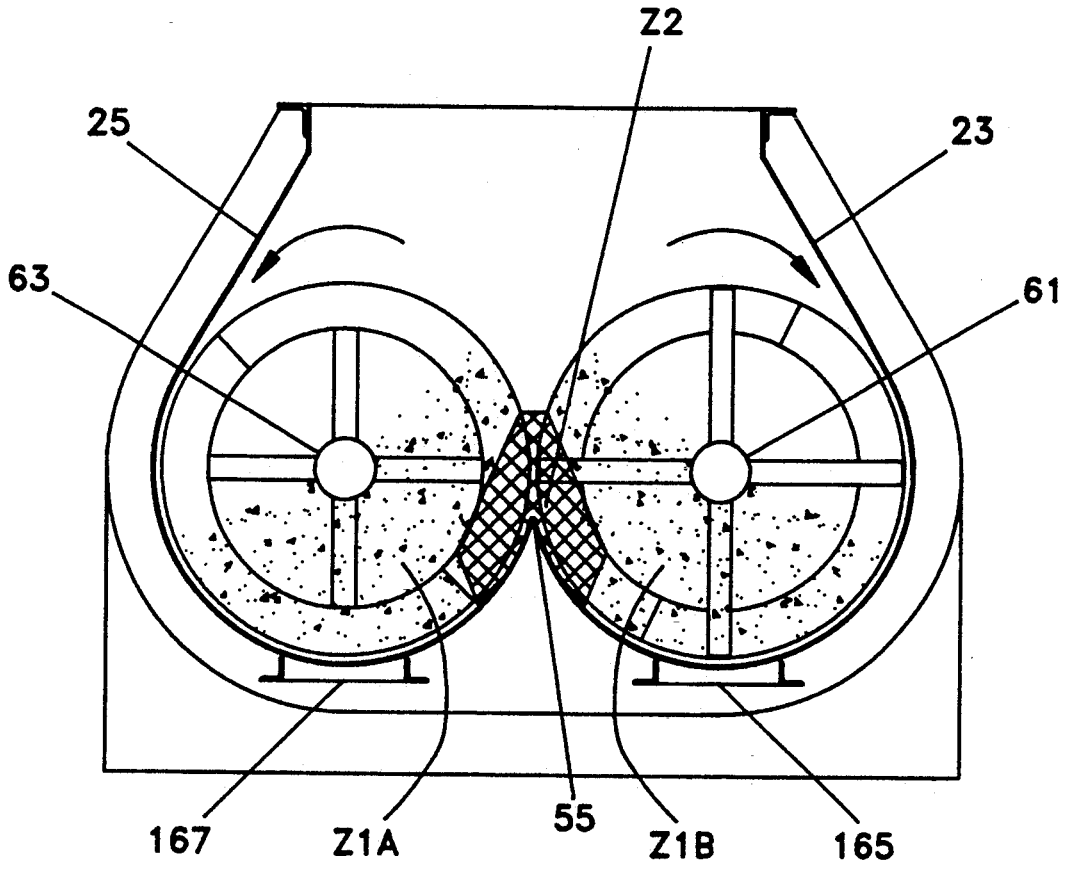
FIG. 5 is a cross-sectional view of FIG. 2 taken through the lines 5—5 thereof without the pitched paddle shown.

As shown in FIG. 5, the outer edges of the ribbon members 81 and 83 of shafts 61 and 63 are spaced from but are located close to each other and are located close to but spaced from the lower walls of the cavities 33A and 33B such that the shafts 61 and 63 with their ribbon members can rotate in the cavities 33A and 33B and relative to each other. The use of two helical ribbons for each shaft increase the mixing efficiency.

Motors 121 and 125 and gear reducers 123 and 127 are provided for rotating the shafts 61 and 63 and their ribbon members 81 and 83 and pitched paddle 105. The motors 121 and 125 are electric motors supported on supports 131 and 133 which are connected to plates 131A and 133A which in turn are connected to the housings of the gear reducers 123 and 127 respectively. Gear reducers 123 and 127 are coupled to the ends 61A and 63A of the shafts 61 and 63 respectively. A belt 121B is coupled to a sheave 121S of the motor 121 and to a sheave 123S of the gear reducer 123 and a belt 125B is coupled to a sheave 125S of the motor 125 and to a sheave 127S of the gear reducer 127. Arms 128A and 128B are connected to the housings of the gear reducers 123 and 127 and to two support members 129 respectively connected to the mixer wall 29 to prevent the housings of the gear reducers 123 and 127 from turning. One of the support members 129 is shown in FIG. 1. The shafts of the motors 121 and 125 are rotated in opposite directions to rotate the shafts 61 and 63 in opposite directions.

The motors 121 and 125; their belts 121B and 125B; and their gear reducers 123 and 127 rotate the shafts 61 and 63 in opposite directions as shown by the arrows 141 and 143 in FIG. 5 such that below the plane 57 of the axes 51 and 53, the ribbon members 81 and 83 of the two shafts 61 and 63 rotate toward each other, upward between the ribbon members, and above the plane 57, away from each other.

In operation, the material to be mixed is introduced into the mixer from the open top into the two cavities 33A and 33B to a level about that of axes 51 and 53. The material to be mixed may be for example, ground corn and vitamins and mineral particles to be fed to livestock.

Figure 8:
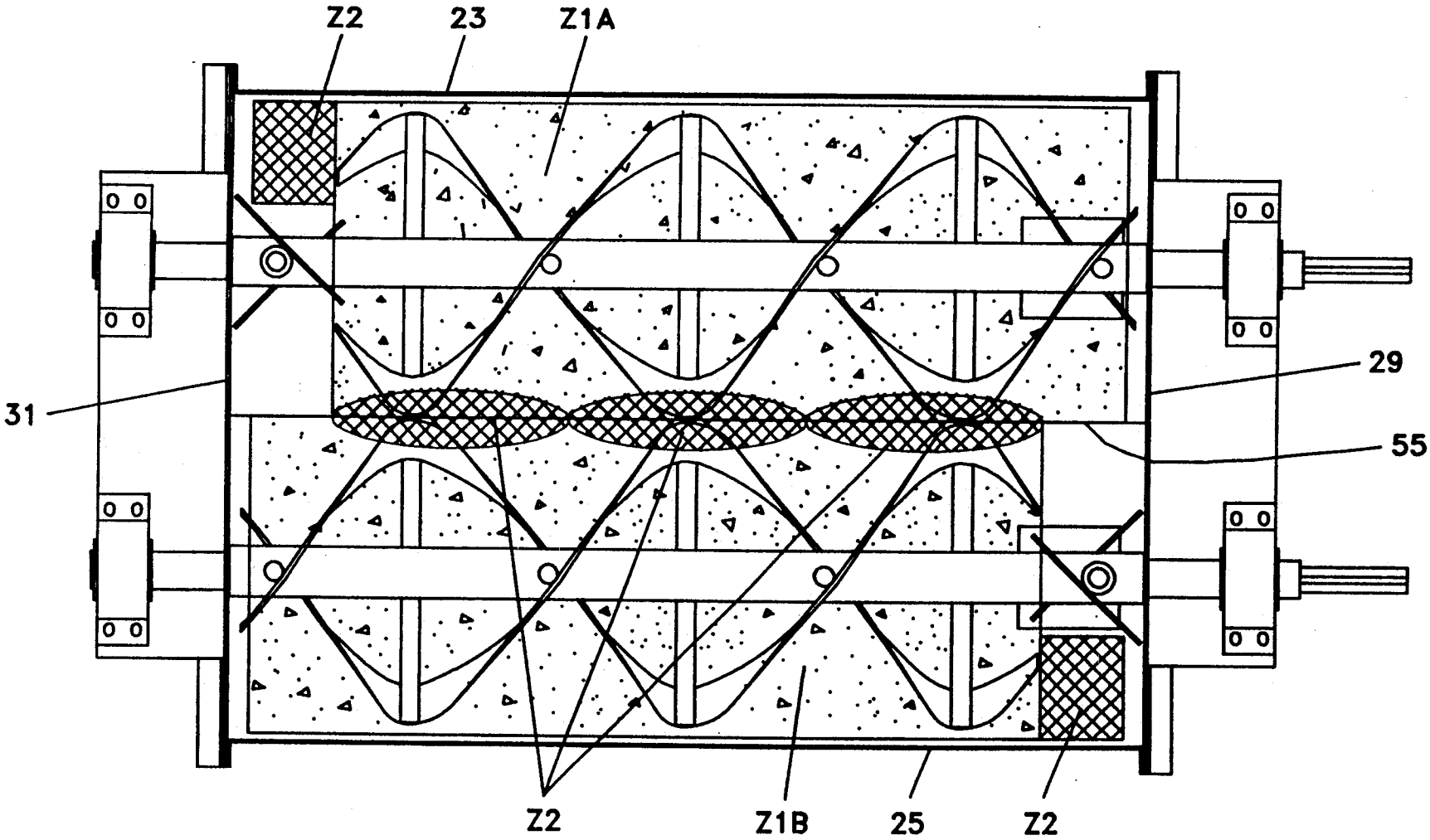
FIG. 8 is a view similar to that of FIG. 2 but illustrating zones of accelerated mixing.

With the shafts 61 and 63 mounted and rotated as disclosed and shown, the ribbon members of shaft 61 will move the material within the confines of the diameter of the helix in the direction shown by the arrows 151 from end 29, along the walls of the cavity 33A to the end 31 and the ribbon members of shaft 63 will move the material within the confines of the diameter of the helix in the direction shown by the arrows 153 from end 31, along the walls of the cavity 33B to the end 29. Simultaneous with this movement, as material is moved along the walls of cavities 33A and 33B, rotational movement of the helix ribbons causes "rolling" of the particles being mixed. This rolling in addition to that action relative to the movement of the product along the walls of cavities 33A and 33B generate central zones Z2 of Repetitive Separation and Division along the apex 55 between the two cavities 33A and 33B which is elemental to mixing of materials. In FIG. 8, the central zones Z2 are shown at a point in time. In FIG. 2, the angled arrows 152 over the apex 55 illustrate product crossing over the apex 55 from one side to the other. The zones Z1A and Z1B are mixing zones in cavities 33A and 33B. The pitched paddles 105 of the shafts 61 and 63 are connected thereto in a manner to cause pitched paddles 105 of shaft 61 to deposit material at end 31 as shown in the direction of the arrow 155 from cavity 33A to cavity 33B and to cause pitched paddles 105 of shaft 63 to deposit material at end 29 as shown in the direction of the arrow 157 from cavity 33B to cavity 33A. In FIG. 8, the zones Z2 next to walls 27A, 23, 31 and 27B, 25, 29 are zones of accelerated mixing in cavities 33A and 33B respectively. Thus the material in the two cavities 33A and 33B circulates along a path as shown by arrows 151, 155, 153 and 157. This action provides division and re-division of the particles many times to promote mixing.

At the same time the helix members of the shafts 61 and 63 move the particles in the two cavities 33A and 33B upward along the bottom wall portions 27A and 27B toward their inner edges 27AI and 27BI and as the helix networks move past the joined position 55 and past each other, particle movement is such that a central accelerated zone Z2 of RS&D (Repetitive Separation and Division) is created, in addition to that which is already taking place at the inner walls of cavities 33A and 33B.

Dimensional ratios are important to this invention. While various sizes of machines are possible, the ratio of length/width preferably should not exceed 1.75 using inside tub dimensions in order to obtain optimum mixing on a time basis. This relates to the ability of a specific helix to move material within a given time space.

Since accelerated mixing takes place at the ends of the mixer of the invention, and since it has been observed that where mixer length/width exceeds 1.75, mix time is lengthened with no enhancement of mix accuracy, it is concluded that by virtue of the accelerated RS&D zones at the ends of the mixer created by the invention, a smaller length/width ratio is achieved than in other ribbon type mixing machines. Prior art ribbon type mixers indicate larger ratios of length/width due to lack of the mixing accelerated zones of the invention.

The use of the helix ribbons, side by side, rotated as described, with the pitched paddles along with the dimensional ratios provide technology that delivers accuracy in mixing as well as economy of power consumption. By utilizing the technologies described, tests indicate a possible 50% savings in power over the conventional ribbon type mixer and 20% to 50% on other types. This savings occurs while still giving better mix and in some cases shorter mix times.

Due to this new technology, less power is consumed while doing equal or superior amounts of work. This is due to the Accelerated RS&D zones created by the invention.

Two discharge openings 161 and 163 with closure members 165 and 167 respectively are provided for discharging the mixed particles into a container (not shown) after the desired mixing has been achieved. The closure members may be manually opened and closed. During mixing they are closed. For discharge purposes they are opened and the shafts rotated to move the particles to the openings for discharge purposes.

In one embodiment, the length of the chamber is 58 inches. Its maximum height is 32 inches and its maximum width is about 40 inches. The radius of the circular arc portion of each cavity from its axis is 10 inches. The diameters of each of the shafts 61 and 63 within the chamber is 2 15/16 inches. The diameter of the cylinder formed by rotation of the ribbon members of each of the shafts is 19.75 inches. The outer peripheries of the cylinders of the ribbon members of the two shafts 61 and 63, formed upon rotation of the ribbon members of the two shafts 61 and 63, are located close to but spaced from each other. The ribbon members 81 and 83 coupled to the shafts 61 and 63 have a pitch of 1.75 such that a complete circle is formed at 35 inches. The ribbon members 81 and 83 extend along the length of each of the shafts 61 and 63 inside the chamber 33 a distance of about 52 inches. Each of the ribbon members 81 and 83 has a thickness of ¼ inches and a width of 2 inches throughout its length. Each of the pitched paddles 105 has dimensions of 7 ½"×14" and is mounted at an angle of 45 degrees relative to the axis of its shaft.

Each of the pitched paddles 105 of shaft 61 has a near edge 105A located next to the end wall 31 and an opposite far edge 105B. The paddles 105 are connected to the shaft 61 at angles such that the leading surfaces 105L of the paddles 105 face away from the end wall 31 such that as the shaft 61 rotates the paddles 105 take material away from the end wall 31 and force it in a direction generally opposite to that in which the ribbons 81 and 83 are pushing the material to equalize the pressure in the vicinity of the end wall 31 and to move material into cavity 33B. This creates a void in cavity 33A behind the leading surfaces of the paddles 105 which enhances mixing. Similarly, each of the pitched paddles 105 of shaft 63 has a near edge 105A located next to the end wall 29 and an opposite far edge 105B. The paddles 105 are connected to the shaft 63 at angles such that the leading surfaces 105L of the paddles face away from the end wall 29 such that as the shaft 63 rotates the paddles 105 take material away from the end wall 29 and force it in a direction generally opposite to that in which the ribbons 81 and 83 are pushing the material to equalize the pressure in the vicinity of the end wall 29 and to move material into cavity 33A. This creates a void in cavity 33B behind the leading surfaces of the paddles 105 which enhances mixing.

The two motors 121 and 125 and their gear reducers can operate independent of each other. The motors 121 and 125 and their gear reducers 123 and 127 rotate the shafts 61 and 63 at 25–30 rpm. This machine has a mixing time of about 15 seconds with minimal power and using Standard Deviation Statical Formulae, a mix with a standard deviation of between 5 and 10 and in some case lower. This unit can replace much larger prior art units that take longer to mix, and which prior art units may never achieve the accuracies of mix of the mixer of the invention. Due to the shorter mix time, the smaller machine of the invention can usually supply more mixed product than larger units of the prior art in a specified period of time. Less power is consumed while doing equal or superior amounts of work.

It is to be understood that the mixer of the invention including its components may have different dimensions than those described above.

I claim:

1. An apparatus for mixing particulate materials, comprising:

a chamber having a given length, width, and height, for receiving particulate materials to be mixed, said chamber having first and second spaced apart side walls, a bottom wall, and first and second spaced apart end walls, with the distance between said first and second end walls defining said length, said bottom wall comprising first and second arcuate shaped bottom wall portions having outer portions which extend to said first and second side walls respectively and inner portions which are coupled together at an intermediate position between said side walls along the length of said chamber forming first and second arcuate shaped cavities having first and second central axes respectively generally parallel to each other and which extend between said first and second end walls, said first and second axes being located in a plane adapted to be located horizontally which extends between said first and second side walls, said first and second bottom wall portions having the same radius from said first and second central axes with the lowest portions of said first and second bottom wall portions being located at a level below said intermediate position, first and second shafts supported for rotation along said first and second axes respectively and which extend between said first and second end walls, two ribbon members coupled to said first shaft such that they are located about 180 degrees apart and extend helically around said first shaft along a substantial portion of the length of said first shaft, two ribbon members coupled to said second shaft such that they are located about 180 degrees apart and extend helically around said second shaft along a substantial portion of the length of said second shaft, drive means for rotating said first and second shafts in opposite directions relative to each other to cause said ribbon members of said first and second shafts to move toward each other below said plane, upward, and away from each other above said plane for mixing the particulate materials together, said ribbon members of said first shaft extending around said first shaft in a manner to cause the particulate material in said first cavity to move from said first end wall toward said second end wall upon rotation of said first shaft by said drive means, said ribbon members of said second shaft extending around said second shaft in a manner to cause the particulate material in said second cavity to move from said second end wall toward said first end wall upon rotation of said second shaft by said drive means, first pitched paddle means coupled to said first shaft only adjacent said second end wall for equalizing the pressure in the vicinity of said second end wall and for causing the particulate material in said first cavity near said second end wall to move to said second cavity upon rotation of said first shaft, and second pitched paddle means coupled to said second shaft only adjacent said first end wall for equalizing the pressure in the vicinity of said first end wall and for causing the particulate material in said second cavity near said first end wall to move to said first cavity upon rotation of said second shaft.

2. The apparatus of claim 1, wherein:

the ratio of said length to said width of said chamber is not greater than about 1.75/1.

3. The apparatus of claim 2, wherein:

said first pitched paddle means comprises two generally flat paddles connected to opposite sides of said first shaft at angles respectively such that each of said flat paddles has a near edge located next to said second end wall and an opposite far edge and a leading surface that faces away from said second end wall, said second pitched paddle means comprises two generally flat paddles connected to opposite sides of said second shaft at angles respectively such that each of said flat paddles has a near edge located next to said first end wall and an opposite far edge and a leading surface that faces away from said first end wall.

4. The apparatus of claim 2, wherein:

each of said ribbon members has a given width and thickness throughout its length with said widths of all of said ribbon members being substantially the same.

5. The apparatus of claim 4, wherein:

each of said ribbon members forms a helix having a given length, each of said ribbon members has a substantially constant pitch angle throughout the length of its helix, the pitch angles of all of said ribbon members are substantially the same.

6. The apparatus of claim 5, wherein:

each said helix of each said ribbon member has a given outside diameter, the outside diameters of all of said helixes are substantially the same.

7. The apparatus of claim 4, wherein:

each of said ribbon members forms a helix having a given outside diameter, the outside diameters of all of said helixes are substantially the same.

8. The apparatus of claim 2, wherein:

each of said ribbon members forms a helix having a given length, each of said ribbon members has a substantially constant pitch angle throughout the length of its helix, the pitch angles of all of said ribbon members are substantially the same.

9. The apparatus of claim 2, wherein:

each of said ribbon members forms a helix having a given outside diameter, the outside diameters of all of said helixes are substantially the same.

10. The apparatus of claim 1, wherein:

each of said ribbon members has a given width and thickness throughout its length with said widths of all of said ribbon members being substantially the same.

11. The apparatus of claim 10, wherein:

each of said ribbon members forms a helix having a given length, each of said ribbon members has a substantially constant pitch angle throughout the length of its helix, the pitch angles of all of said ribbon members are substantially the same.

12. The apparatus of claim 11, wherein:

each said helix of said each ribbon member has a given outside diameter, the outside diameter of all of said helixes are substantially the same.

13. The apparatus of claim 10, wherein:

each of said ribbon members forms a helix having a given outside diameter, the outside diameters of all of said helixes are substantially the same.

14. The apparatus of claim 1, wherein:

said first pitched paddle means comprises two generally flat paddles connected to opposite sides of said first shaft at angles respectively such that each of said flat paddles has a near edge located next to said second end wall and an opposite far edge and a leading surface that faces away from said second end wall, said second pitched paddle means comprises two generally flat paddles connected to opposite sides of said second shaft at angles respectively such that each of said flat paddles has a near edge located next to said first end wall and an opposite far edge and a leading surface that faces away from said first end wall.

15. The apparatus of claim 14, wherein:

said two flat paddles of said first pitched paddle means are transverse to each other and form angles relative to the axis of said first shaft which are about 45 degrees respectively, said two flat paddles of said second pitched paddle means are transverse to each other and form angles relative to the axis of said second shaft which are about 45 degrees respectively.

16. The apparatus of claim 1, wherein:

said ribbon members of said first and second shafts form two cylinders respectively upon rotation thereof with the outer peripheries of said ribbon members of said first and second shafts being located close to but spaced from each other.

17. The apparatus of claim 1, wherein:

said drive means for rotating said first and second shafts comprise first and second drive means respectively, which operate independent of each other.

18. The apparatus of claim 1, wherein:

each of said ribbon members forms a helix having a given length, each of said ribbon members has a substantially constant pitch angle throughout the length of its helix, the pitch angles of all of said ribbon members are substantially the same.

19. The apparatus of claim 1, wherein:

each of said ribbon members forms a helix having a given outside diameter, the outside diameters of all of said helixes are substantially the same.

20. An apparatus for mixing particulate materials, comprising:

a chamber having a given length, width, and height, for receiving particulate materials to be mixed, the ratio of said length to said width of said chamber is not greater than about 1.75/1, said chamber having first and second spaced apart side walls, a bottom wall, and first and second spaced apart end walls, with the distance between said first and second end walls defining said length, said bottom wall comprising first and second arcuate shaped bottom wall portions having outer portions which extend to said first and second side walls respectively and inner portions which are coupled together at an intermediate position between said side walls along the length of said chamber forming first and second arcuate shaped cavities having first and second central axes respectively generally parallel to each other and which extend between said first and second end walls, said first and second axes being located in a plane adapted to be located horizontally which extends between said first and second side walls, said first and second bottom wall portions having the same radius from said first and second central axes with the lowest portions of said first and second bottom wall portions being located at a level below said intermediate position, first and second shafts supported for rotation along said first and second axes respectively and which extend between said first and second end walls, two ribbon members coupled to said first shaft such that they are located about 180 degrees apart and extend helically around said first shaft along a substantial portion of the length of said first shaft, two ribbon members coupled to said second shaft such that they are located about 180 degrees apart and extend helically around said second shaft along a substantial portion of the length of said second shaft, power means for rotating said first and second shafts in opposite directions relative to each other to cause said ribbon members of said first and second shafts to move toward each other below said plane, upward, and away from each other above said plane for mixing the particulate materials together, said ribbon members of said first shaft extending around said first shaft in a manner to cause the particulate material in said first cavity to move from said first end wall toward said second end wall upon rotation of said first shaft by said power means, said ribbon members of said second shaft extending around said second shaft in a manner to cause the particulate material in said second cavity to move from said second end wall toward said first end wall upon rotation of said second shaft by said power means, first pitched paddle means coupled to said first shaft only adjacent said second end wall for equalizing the pressure in the vicinity of said second end wall and for causing the particulate material in said first cavity near said second end wall to move to said second cavity upon rotation of said first shaft, and second pitched paddle means coupled to said second shaft only adjacent said first end wall for equalizing the pressure in the vicinity of said first end wall and for causing the particulate material in said second cavity near said first end wall to move to said first cavity upon rotation of said second shaft.

21. The apparatus of claim 20, wherein:

each of said ribbon members has a given width and thickness throughout its length with said widths of all of said ribbon members being substantially the same.

22. The apparatus of claim 21, wherein:

each of said ribbon members forms a helix having a given length, each of said ribbon members has a substantially constant pitch angle throughout the length of its helix, the pitch angles of all of said ribbon members are substantially the same.

23. The apparatus of claim 20, wherein:

each of said ribbon members forms a helix having a given length, each of said ribbon members has a substantially constant pitch angle throughout the length of its helix, the pitch angles of all of said ribbon members are substantially the same.

* * * * *